US006648305B2

(12) United States Patent
House et al.

(10) Patent No.: US 6,648,305 B2
(45) Date of Patent: Nov. 18, 2003

(54) FENCE TENSIONER

(75) Inventors: Gary L. House, Rogersville, AL (US); Edward S. Robbins, III, 2802 E. Avalon Ave., Muscle Shoals, AL (US) 35661; Harry Raney, Florence, AL (US); John Saylor, Florence, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 56 days.

(21) Appl. No.: 09/988,827

(22) Filed: Nov. 20, 2001

(65) Prior Publication Data

US 2003/0094602 A1 May 22, 2003

(51) Int. Cl.[7] ..... E04H 17/02

(52) U.S. Cl. ..... 256/40; 256/37; 256/41; 256/42

(58) Field of Search ..... 256/1, 10, 32, 256/37–44, 47; 403/104–106; 254/213, 223, 243

(56) References Cited

U.S. PATENT DOCUMENTS

| | | | | | |
|---|---|---|---|---|---|
| 83,038 | A | | 10/1868 | Chaplin | |
| 172,460 | A | | 1/1876 | Lightfoot | |
| 192,494 | A | * | 6/1877 | Duffey | 256/42 |
| 301,037 | A | | 6/1884 | Worcester | |
| 393,504 | A | | 11/1888 | Fuller | |
| 402,439 | A | | 4/1889 | Haas | |
| 409,597 | A | * | 8/1889 | Arnold et al. | 256/42 |
| 417,993 | A | | 12/1889 | Doud | |
| 420,819 | A | | 2/1890 | Merchant | |
| 445,330 | A | | 1/1891 | Kiler | |
| 473,899 | A | | 5/1892 | Berdan | |
| 476,655 | A | | 6/1892 | Kintner | |
| 484,061 | A | * | 10/1892 | Spillinger | 256/39 |
| 499,279 | A | | 6/1893 | Bird | |
| 516,040 | A | | 3/1894 | Wyssinger et al. | |
| 562,015 | A | * | 6/1896 | Morgan | 24/134 R |
| 591,732 | A | | 10/1897 | Bohner | |
| 596,987 | A | | 1/1898 | Diller | |
| 658,671 | A | | 9/1900 | Northrup | |
| 664,771 | A | | 12/1900 | McCallum | |
| 828,382 | A | | 8/1906 | Campbell | |
| 850,612 | A | | 4/1907 | Beltzer | |
| 1,019,071 | A | * | 3/1912 | Miller | 256/32 |
| 1,250,631 | A | | 12/1917 | Novess | |
| 1,998,185 | A | | 4/1935 | Broderick | |
| 2,429,590 | A | | 10/1947 | Ames | |
| 2,527,877 | A | | 10/1950 | Docken | |
| 3,416,763 | A | * | 12/1968 | Moreno | 24/68 R |
| 3,848,367 | A | * | 11/1974 | Barnes | 52/157 |
| 3,856,265 | A | * | 12/1974 | Foster | 254/161 |
| 4,465,263 | A | | 8/1984 | Robbins, Jr. | |
| 4,706,942 | A | | 11/1987 | Robbins, Jr. | |
| 6,152,429 | A | | 11/2000 | Pettigrew | |
| 2003/0062515 | A1 | * | 4/2003 | Petigrew | 256/40 |

* cited by examiner

*Primary Examiner*—Lynne H. Browne
*Assistant Examiner*—Michael P. Ferguson
(74) *Attorney, Agent, or Firm*—Nixon & Vanderhye P.C.

(57) ABSTRACT

A tensioner device for applying tension to a flexible fence slat includes a bracket assembly having attachment webs for attachment to a fence post and a pair of vertically spaced, horizontally oriented flanges. A tensioning cylinder is mounted for rotation within a pair of apertures provided, respectively, in the horizontally oriented flanges, the tensioning cylinder formed with a through-slot extending longitudinally between a pair of radial flanges. The through-slot has a length substantially equal to a width of the flexible fence slat and adapted to receive one end of the fence slat. A ratchet wheel is formed at one end of the cylinder, between one of the radial flanges and one of the horizontally oriented flanges, and a pawl is pivotably mounted on the adjacent one of the horizontally oriented flanges for engagement with the ratchet so as to permit rotation of the tensioning cylinder in a tensioning direction but to prevent rotation of the tensioning cylinder in an opposite direction. A finger tab on the pawl facilitates moving the pawl into or out of engagement with the ratchet.

18 Claims, 7 Drawing Sheets

FENCE TENSIONER

BACKGROUND OF THE INVENTION

This invention relates to fence tensioners especially designed for use with flexible polymer fence slats.

Fences are the most commonly employed means for confining that which would otherwise escape and excluding that which would otherwise intrude. Fences may vary greatly in both structure and materials of composition. Common fence structures include wire fences, such as barbed wire and chain link, and wood fences such as, picket fences and split rail fences. Common fence materials include metal, wood and stone. Fence structure and composition are selected on the basis of initial and upkeep costs, durability, strength, aesthetic characteristics, and safety desired or required.

One very common form of fencing is barbed wire. The relatively low cost of purchasing, installing, and maintaining barbed wire fencing has made it the preeminent fencing material for enclosing livestock areas. Barbed wire suffers from the disadvantage, however, that its sharp barbs may cut or gouge the hide of valuable livestock. Furthermore, barbed wire has a very thin cross-section so that it is not easy to see; and an animal is correspondingly more apt to contact a barbed wire fence than it would be to contact a more visible barrier. Other types of wire fencing known in this art, such as web wire fencing, and cyclone wire fencing, suffer from similar limitations. These wire fences also tend to have poor aesthetic qualities and they tend to rust or corrode after a few years of service. Fences made entirely of wood, on the other hand, are typically safer and more pleasing to the eye, but are expensive to install and maintain.

Over the past several years, composite metal and plastic fence systems have become increasingly accepted for the confinement of livestock, thoroughbred horses and the like. Typically, the fence slats are comprised of at least two wires or other high strength fibers encased in a polymer such as vinyl or other suitable plastic web. Depending on the width of the fence slat, two wires may extend along the opposite edges of the slat or, for wider slats, a third wire may be added intermediate the edge wires. Examples of such fencing construction can be found in U.S. Pat. Nos. 4,465,263 and 4,706,942.

To maximize the effectiveness of the flexible fence slats, tensioning devices must be utilized to insure that the individual slats do not sag between posts. Fence tensioners have long been used to tighten individual strands in wire fence systems. Examples may be found in U.S. Pat. Nos. 393,504; 420,819; 473,899; 516,040; 596,987; 658,671. A fence tensioner for polymer fence slats is disclosed in the more recently issued U.S. Pat. No. 6,152,429.

BRIEF DESCRIPTION OF THE INVENTION

The present invention relates to an improved fence tensioner designed especially for use with flexible polymer fence slats with reinforcing wires embedded therein. In one exemplary embodiment, a tensioning cylinder is mounted for rotation in a pair of bracket flanges formed in respective discrete attachment webs. The attachment webs are designed for adjustment at the manufacturing stage to change the distance between the bracket flanges to accommodate tensioning cylinders of different lengths, thus allowing the tensioning device to be used with fence slats of different widths. Once the appropriate cylinder has been located between the flanges, with integral axle stubs received in aligned holes in the flanges, the attachment webs of the bracket assembly are riveted or otherwise permanently secured to each other.

The tensioning cylinder has a smooth peripheral surface with annular grooves located so as to corresponding with the location of the embedded wires in the fence slat. A longitudinal slot through the cylinder is designed to receive a free end of the fence slat, without having to strip the plastic from the ends of the reinforcing wires. An integral ratchet wheel is formed on the cylinder, inside and adjacent one of the bracket flanges. Teeth on the ratchet wheel are adapted to be engaged by a pawl pivotally mounted on the bracket flange. This is a conventional ratchet and pawl arrangement that permits rotation of the ratchet wheel in a tensioning direction but prevents rotation in an opposite or tension release direction. In this regard, the pawl may be spring biased into engagement with the ratchet wheel, or may be manually moved into or out of engagement by means of a finger tab.

In another embodiment of the invention, a larger bracket assembly is provided that mounts a pair of tensioning cylinders at opposite ends thereof. The adjustability feature at the manufacturing stage for accommodating cylinders of different lengths is maintained.

Accordingly, in its broader aspects, the invention relates to a tensioner device for applying tension to a flexible fence slat comprising a bracket assembly having attachment webs for attachment to a fence post and a pair of vertically spaced, horizontally oriented flanges; a tensioning cylinder mounted for rotation within a pair of apertures provided, respectively, in the horizontally oriented flanges, the tensioning cylinder formed with a through-slot extending longitudinally between a pair of radial flanges, the through-slot having a length substantially equal to a width of the flexible fence slat and adapted to receive one end of the fence slat; a ratchet wheel at one end of the cylinder, between one of the radial flanges and one of the horizontally oriented flanges; a one-way pawl pivotably mounted on the one of the horizontally oriented flanges for engagement with the ratchet so as to permit rotation of the tensioning cylinder in a tensioning direction but to prevent rotation of the tensioning cylinder in an opposite direction; and a finger tab on the pawl for moving the pawl into or out of engagement with the ratchet.

In another aspect, the invention relates to fence tensioner device for applying tension to a flexible fence slat comprising a bracket assembly having a pair of vertically adjustable webs for attaching the device to a fence post and a first pair of vertically spaced, horizontally oriented flanges; a first tensioning cylinder mounted for rotation within a pair of apertures provided, respectively, in the horizontally oriented flanges, the tensioning cylinder formed with a through-slot extending longitudinally between a pair of radial flanges, the through-slot having a length substantially equal to a width of the flexible fence slat and adapted to receive one end of the fence slat; wherein the bracket assembly comprises two mirror image half sections, with one vertical web on one half section in back-to-back relationship with another vertical web on the other half section, each half section formed with a respective one of the pair of horizontally oriented flanges, the half sections being fixed to each other after the tensioning cylinder is mounted within the apertures.

In still another aspect, the invention relates to fence tensioner assembly for applying tension to a pair of flexible fence slats comprising a bracket assembly having a pair of mirror-image half portions, including a pair of attachment webs in back-to-back relationship, one half portion having a first pair of laterally spaced horizontally oriented flanges along an upper edge thereof, vertically alignable with a second pair of laterally spaced horizontally oriented flanges along a lower edge of the other half portion; and a pair of tensioning cylinders mounted between the first and second pair-of horizontally oriented flanges, the pair of tensioning cylinders each having a slot for receiving a free end of a fence slat, and means facilitating rotation of said pair of tensioning cylinders to tension the fence slats and means for locking the fence slats in a tensioned position.

The invention will now be disclosed in further detail in connection with the drawings described below.

DETAILED DESCRIPTION OF THE INVENTION

Figure 1:
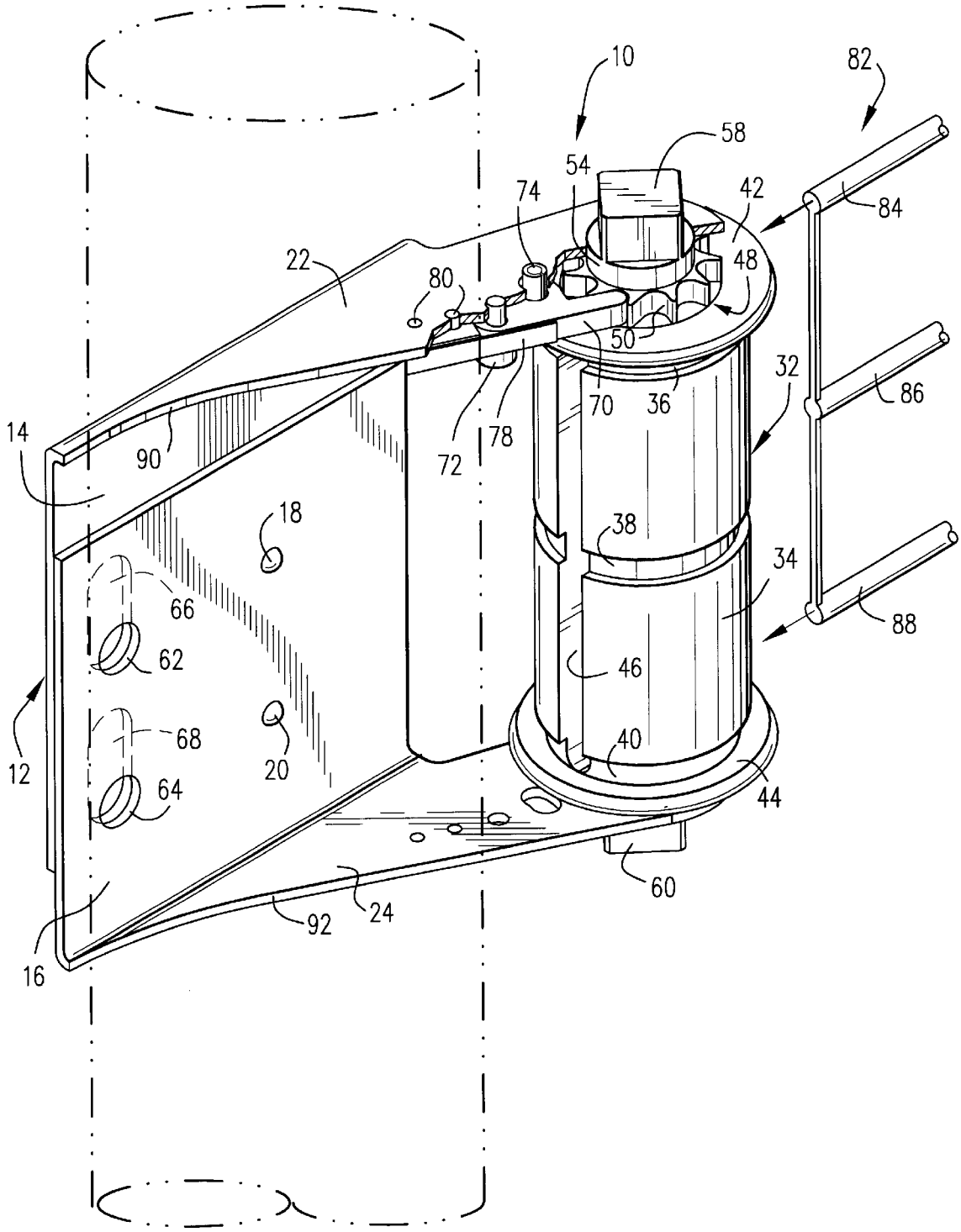
FIG. 1 is a perspective view of a fence tensioner in accordance with the first exemplary embodiment of the invention.
Figure 2:
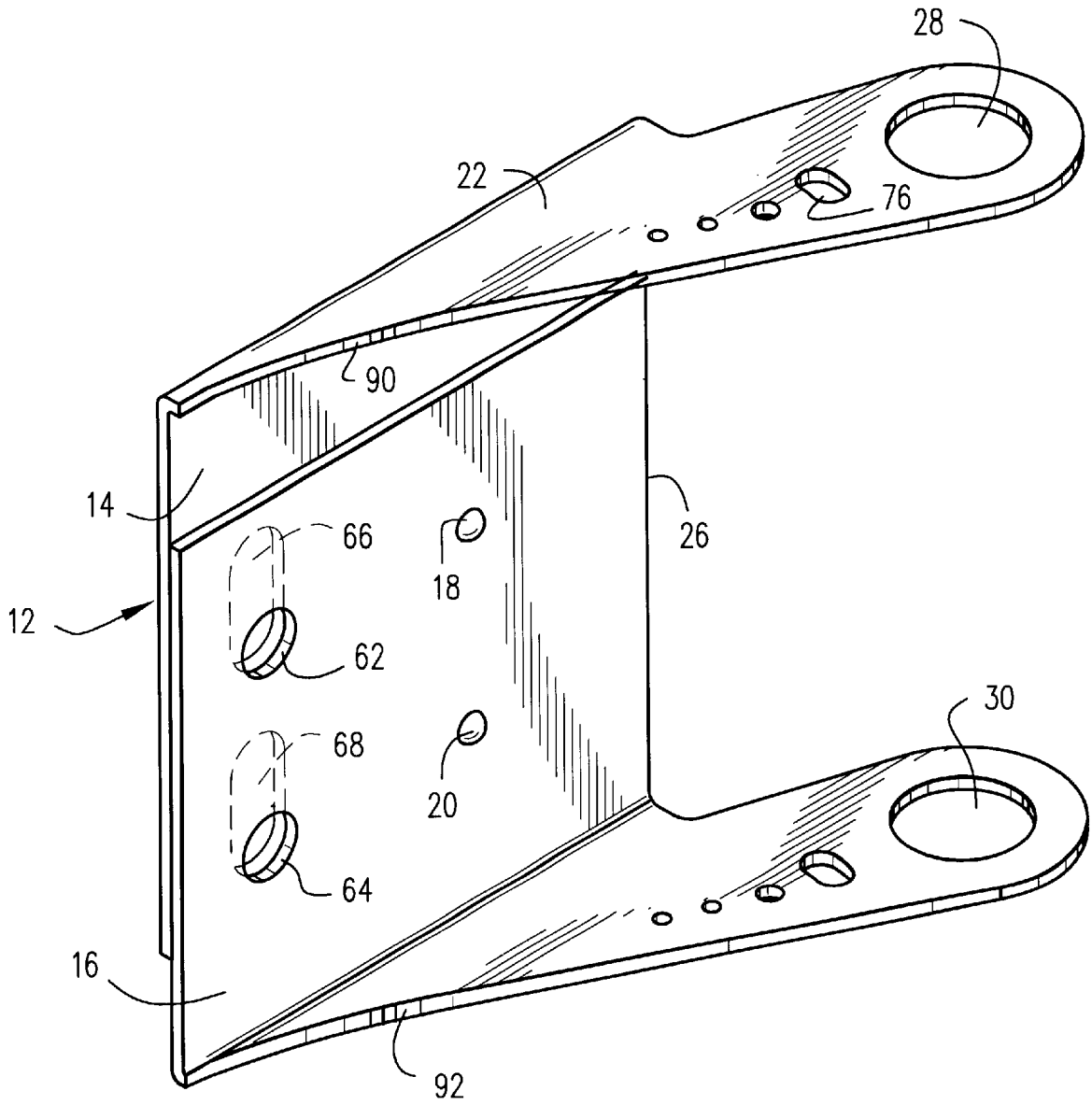
FIG. 2 is a perspective view of the bracket assembly taken from the fence tensioner shown in FIG. 1.
Figure 3:
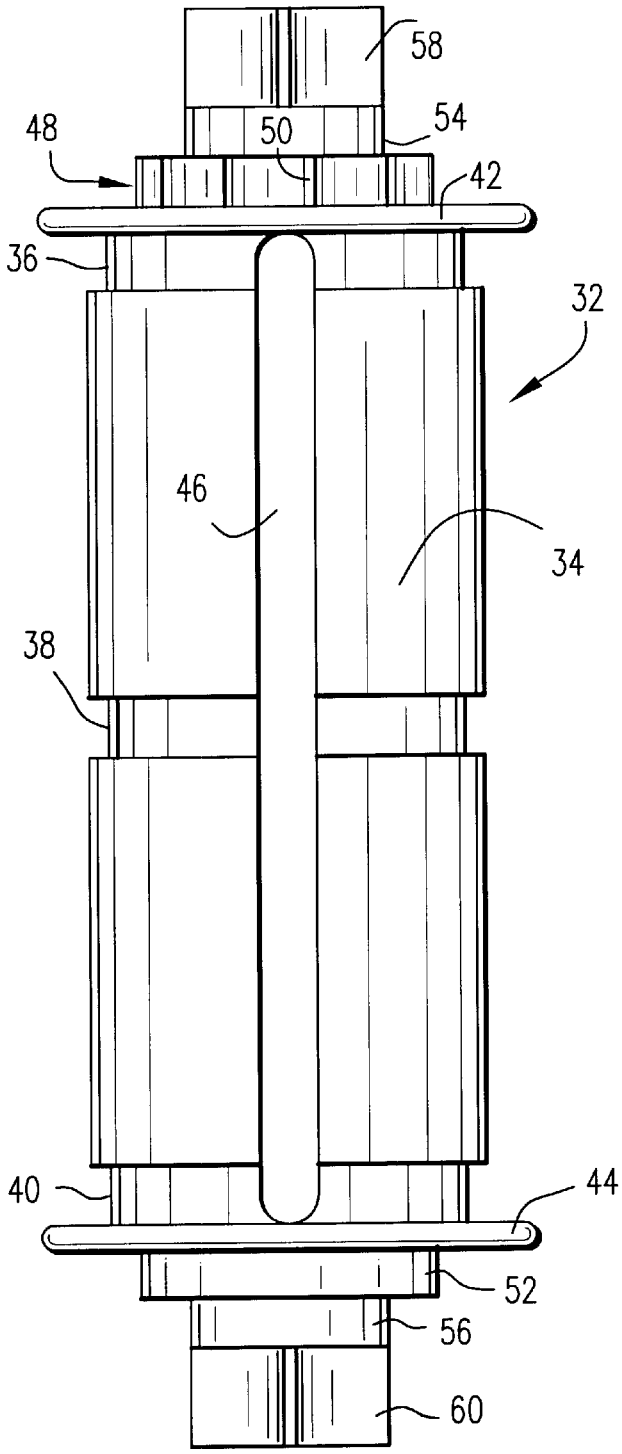
FIG. 3 is a side elevation of the tensioning cylinder taken from the fence tensioner shown in FIG. 1.
Figure 4:
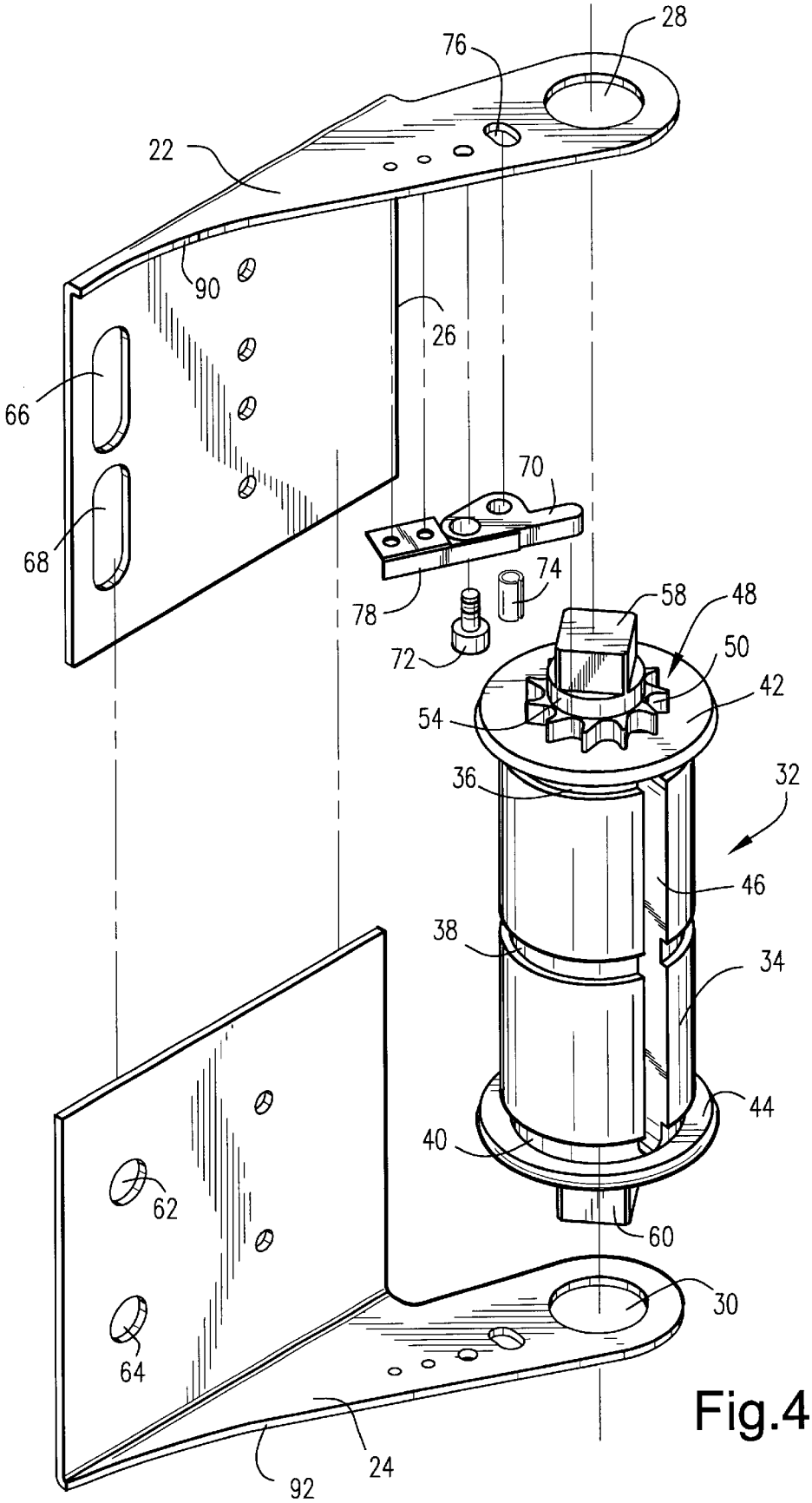
FIG. 4 is a perspective exploded view of the fence tensioner shown in FIG. 1.

The fence tensioner 10 includes a bracket assembly 12 that includes first and second vertically oriented attachment webs 14, 16 in back-to-back relationship, permanently secured to each other by means of rivets 18, 20 or other suitable means. The webs are formed with respective horizontally oriented flanges 22, 24 along upper and lower edges of the webs, and extending beyond side edges 26 of the webs. The horizontally oriented flanges 22, 24 are formed with respective vertically aligned holes 28, 30 that serve to mount a tensioning cylinder 32 as described further below.

The tensioning cylinder 32 has a substantially smooth fence slat engaging peripheral surface 34, with annular machined grooves 36, 38 and 40 at respective upper, middle and lower portions of surface 34. Adjacent the grooves 36 and 40, radial flanges 42, 44 are formed, with diameters greater than the diameter of the surface 34. The grooves 36, 38 and 40 are adapted to receive the longitudinally extending ridges on the fence slat that correspond to the location of the reinforcing wires embedded in the slat. Thus, the grooves 36, 38 and 40 along with the flanges 42, 44 confine the slat and insure that it is wound straight on the tensioning cylinder 32. To secure the slat to the cylinder 32, the latter is provided with a longitudinal through-slot 46 that extends between flanges 42, 44.

To the outside of flange 42, an integral ratchet wheel 48 is formed with teeth 50 extending from a solid center hub. To the outside of flange 44, a solid cylindrical blank section 52 is formed, having a diameter similar to that of ratchet wheel 48. Reduced diameter axle stubs 54, 56 extend from the ratchet wheel 48 and blank section 52, respectively, with respective multi-sided tool heads 58, 60 at opposite remote ends of the tensioning cylinder 32.

During assembly, the flanges 22, 24 of the bracket are located such that axle stubs 54, 56 are seated within holes 28, 30, respectively, in the bracket flanges 22, 24. The two bracket webs 14, 16 are then secured together via the rivets 18, 20 or other suitable fasteners, thereby locking the tensioning cylinder 32 in place, for rotation about the longitudinal axis of the cylinder, i.e., the cylinder turns with its axle stubs 54, 56 rotating within the apertures 28, 30.

Holes 62, 64 in web 16 align with slots 66, 68 in web 14 to permit the tensioner to be secured to a fence post by suitable fasteners.

It will also be appreciated that by employing slots 66, 68 on one of the webs, the bracket can be "opened" or "closed" to accept tensioning cylinders 32 of different lengths, minimizing the components necessary to accept various fence slat widths. The bracket assembly as shown in FIG. 1 is in the "open position" to accept, e.g., a tensioning cylinder designed for a five inch wide slat. When closed, a tensioning cylinder designed to accommodate a smaller width slat (e.g., a four inch wide slat) may be used with the same bracket assembly.

A pawl lever 70 is pivotally secured to the bracket flange 22 via finger adjustable screw 72 and located such that the tip of the pawl lever is adapted to engage the ratchet wheel 48 between adjacent pairs of teeth 50. As is well known in the art, the ratchet wheel 48 and pawl 70 are configured and arranged to permit rotation of the cylinder 32 in a fence slat tensioning direction but not in an opposite or release direction. This insures that the fence slat will remain tensioned after the tightening steps are complete. A finger tab 74 on the pawl extends through an arcuate slot 76 in the flange 22. This allows the user to pivot the pawl 70 into or out of engagement with the ratchet wheel 48. Finger screw 72 is utilized to provide the desired resistance to rotation in the pawl. It will be appreciated that the pawl 70 could be biased into a wheel engaging position by a leaf spring 78 (or the like) secured via pins 80 to the flange 22, but it is not necessary to do so.

In use, a flexible fence slat 82 reinforced by wires embedded at 84, 86 and 88 is inserted into the slot 46 and a wrench or other torque applying tool is located over one of the heads 58 or 60. With the pawl 70 moved to a ratchet engaging position, the tensioning cylinder 32 is rotated to wind the slat about the cylinder and thus tension the slat to the desired degree. The wrench or other tool is then removed, with the pawl 70 remaining fully engaged between two adjacent teeth 50 on the ratchet wheel 48 to thus prevent back rotation of the cylinder.

As indicated above, the bracket assembly 12 will accommodate tension cylinders 32 of different lengths. For slats of lesser width, e.g., 4 inches, the reinforcing wires may be confined to the upper and lower edges of the slat and thus the middle groove 38 on the cylinder 32 can be omitted.

Figure 7:
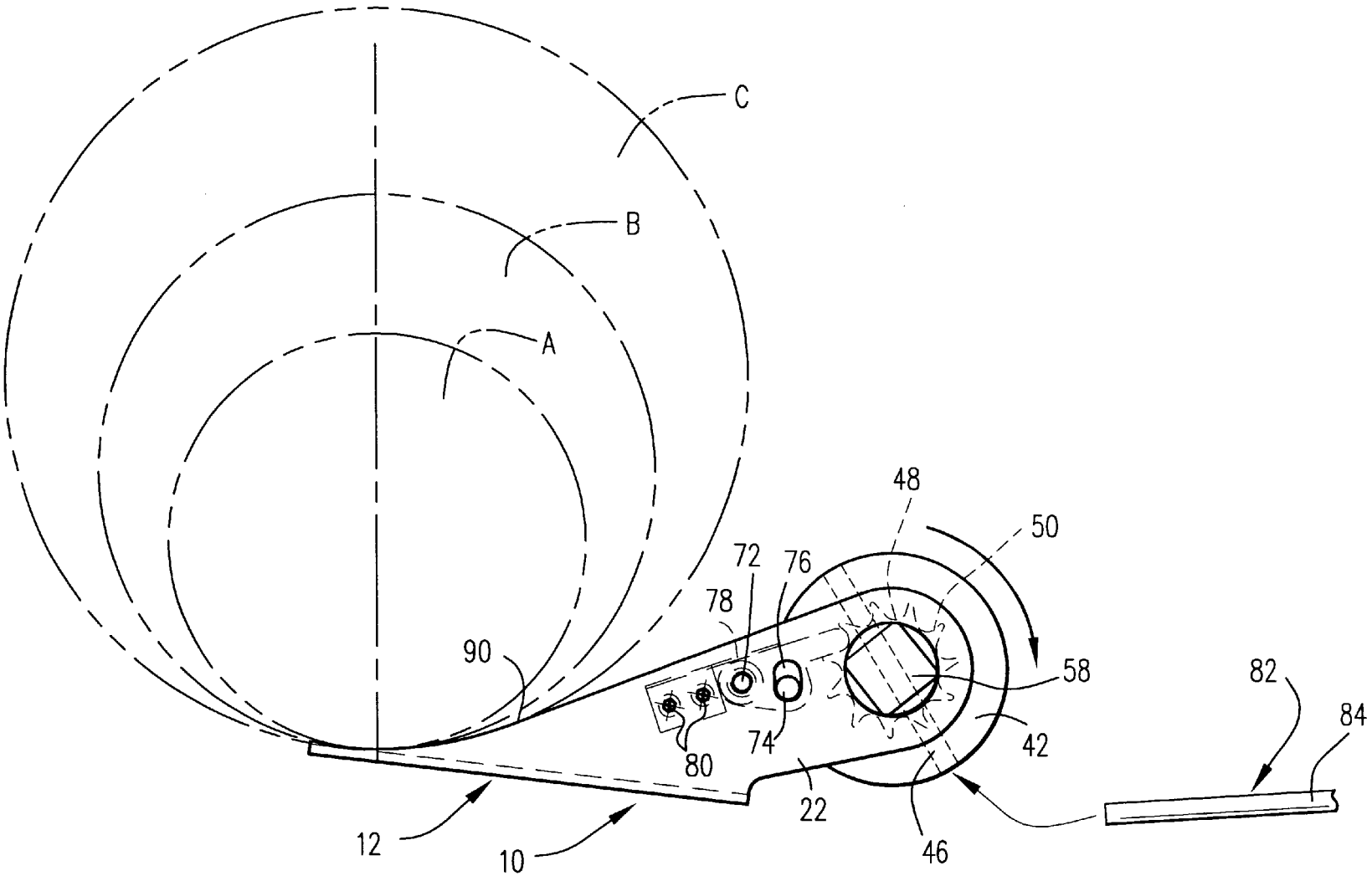
FIG. 7 is a plan view of the fence tensioner shown in FIG. 1, illustrating how the fence tensioner is adapted for use with fence posts of different diameters.

The web arrangement and particularly the widely curved edges 90, 92 along flanges 22, 24 permit the bracket to be secured to square, rectangular or round fence posts A, B, C or D of various diameters (see FIG. 7).

Figure 5:
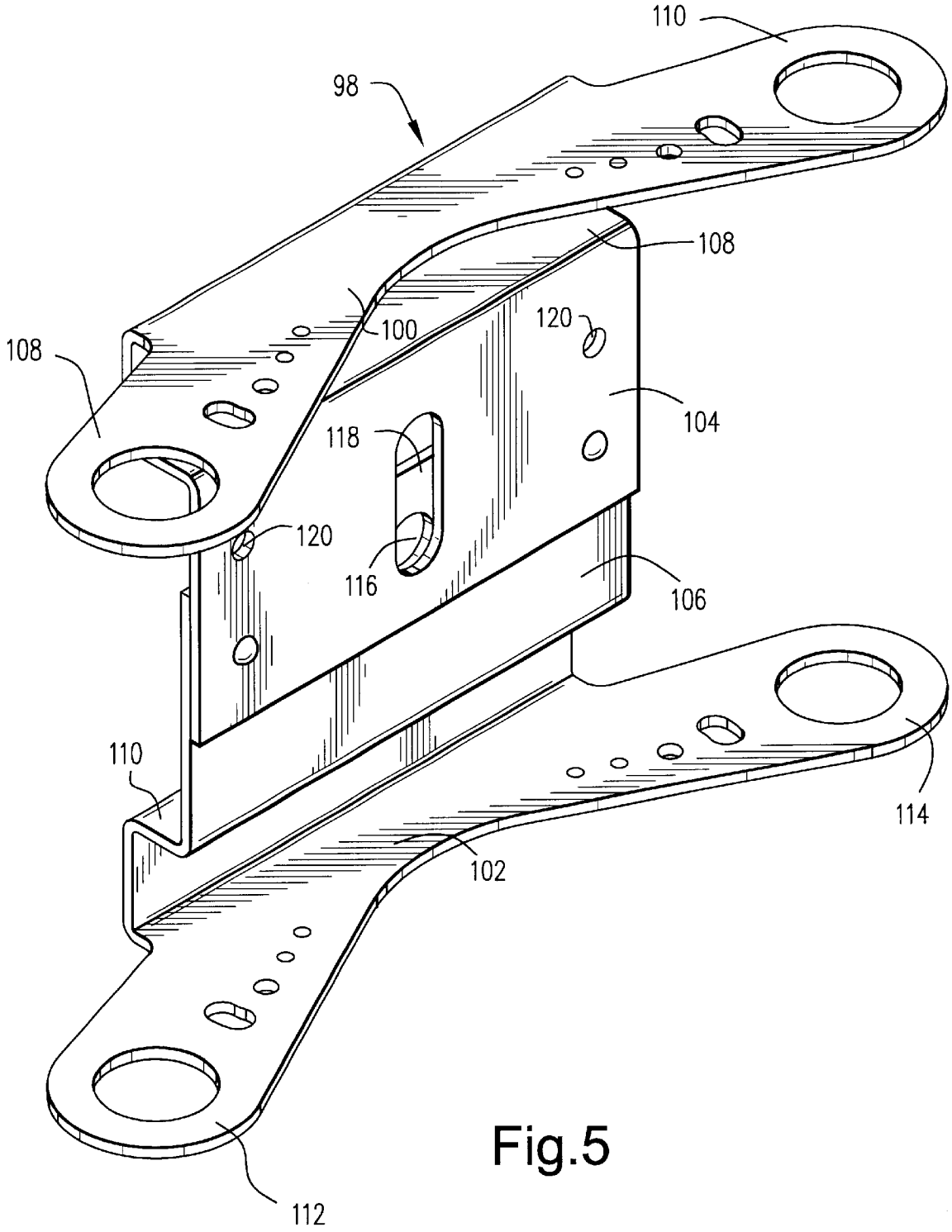
FIG. 5 is a perspective view of a bracket assembly for a fence tensioner in accordance with the second exemplary embodiment of the invention.
Figure 6:
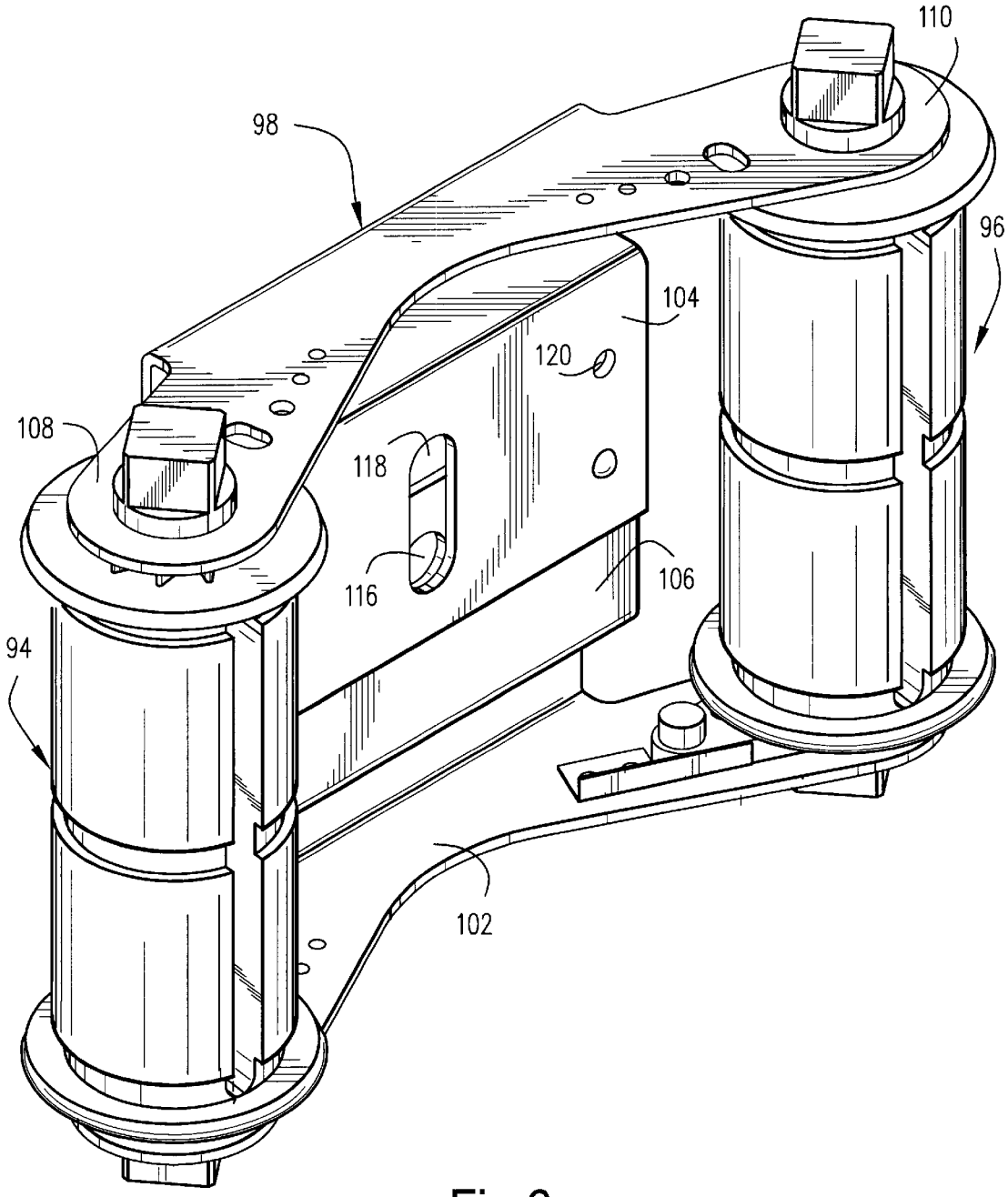
FIG. 6 is a perspective view of a fully assembled fence tensioner in accordance with the second embodiment of the invention.

FIGS. 5 and 6 illustrate another embodiment of the invention where a pair of tensioning cylinders 94, 96 are supported on opposite ends of an enlarged bracket assembly 98. The cylinders 94, 96 are identical to cylinder 32 and need not be described further.

The bracket assembly 98 is also similar to bracket assembly 12, but horizontal flanges 100, 102 on respective attachment webs 104, 106 are extended to include mirror image cylinder attachment ends 108, 100 on flange 100 and 112, 114 on flange 102. The attachment webs 104, 106 each have offsets or shoulders 108, 110 but are otherwise similar to webs 14, 16. Thus, the use of hole 116 and slot 118 allow the webs to be moved between open and closed positions to accept cylinders of different lengths, and selected rivet holes 120 are used to secure the webs after the cylinders 96 are in place. The ratchet and pawl arrangement remains as described above.

The double tensioner shown in FIGS. 5 and 6 is useful on any post where free ends of fence slats meet, whereas the fence tensioner shown in FIGS. 1–4 and 7 is useful particularly on termination posts.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A tensioner device for applying tension to a substantially flat, flexible fence slat, the tensioner device comprising:

a bracket assembly having attachment webs for attachment to a fence post and a pair of vertically spaced, horizontally oriented flanges; a tensioning cylinder mounted for rotation within a pair of apertures provided, respectively, in said horizontally oriented flanges, said tensioning cylinder having a pair of end flanges and formed with a through-slot extending longitudinally from one of said pair of end flanges to the other of said pair of end flanges, said through-slot having a length substantially equal to a width of the substantially flat flexible fence slat and adapted to receive one end of said substantially flat fence slat; a ratchet wheel at one end of said cylinder, between one of said radial flanges and one of said horizontally oriented flanges; a pawl lever pivotably mounted on said one of said horizontally oriented flanges for engagement with said ratchet wheel so as to permit rotation of said tensioning cylinder in a tensioning direction but to prevent rotation of said tensioning cylinder in an opposite direction; and a finger tab on said pawl for moving said pawl into or out of engagement with said ratchet.

2. The tensioner device of claim 1 and further including at least one multi-sided tool head on one end of said tensioning cylinder, adapted to receive a torque application tool.

3. The tensioner device of claim 2 and further including a second multi-sided tool head on an opposite end of said tensioning cylinder.

4. The tensioner device of claim 3 wherein said at least one multi-sided tool head and said second multi-sided tool head are located, respectively, outside said horizontally oriented flanges.

5. The tensioner device of claim 1 wherein said pawl is secured to said one horizontally oriented flange by means of a finger-adjustable screw.

6. The tensioner device of claim 1 wherein said bracket assembly comprises two mirror image half sections, with one vertical web on one half section in back-to-back relationship with a second vertical web on the other half section, each half section formed with a respective one of said pair of horizontally oriented flanges, the half sections being fixed to each other after said tensioning cylinder is mounted within said apertures.

7. The tensioner device of claim 6 wherein said tensioning cylinder is formed with a pair of integral axle stubs located, respectively, in said pair of apertures.

8. A tensioner device for applying tension to a flexible fence slat comprising:

a bracket assembly having attachment webs for attachment to a fence post and a pair of vertically spaced, horizontally oriented flanges; a tensioning cylinder mounted for rotation within a pair of apertures provided, respectively, in said horizontally oriented flanges, said tensioning cylinder formed with a through-slot extending longitudinally between a pair of radial flanges, said through-slot having a length substantially equal to a width of the flexible fence slat and adapted to receive one end of said fence slat; a ratchet wheel at one end of said cylinder, between one of said radial flanges and one of said horizontally oriented flanges; a pawl lever pivotably mounted on said one of said horizontally oriented flanges for engagement with said ratchet wheel so as to permit rotation of said tensioning cylinder in a tensioning direction but to prevent rotation of said tensioning cylinder in an opposite direction; and a finger tab on said pawl for moving said pawl into or out of engagement with said ratchet; wherein said finger tab extends through an arcuate slot formed in said one of said horizontally oriented flanges.

9. A tensioner device for applying tension to a flexible fence slat comprising:

a bracket assembly having attachment webs for attachment to a fence post and a pair of vertically spaced, horizontally oriented flanges; a tensioning cylinder mounted for rotation within a pair of apertures provided, respectively, in said horizontally oriented flanges, said tensioning cylinder formed with a through-slot extending longitudinally between a pair of radial flanges, said through-slot having a length substantially equal to a width of the flexible fence slat and adapted to receive one end of said fence slat; a ratchet wheel at one end of said cylinder, between one of said radial flanges and one of said horizontally oriented flanges; a pawl lever pivotably mounted on said one of said horizontally oriented flanges for engagement with said ratchet wheel so as to permit rotation of said tensioning cylinder in a tensioning direction but to prevent rotation of said tensioning cylinder in an opposite direction; and a finger tab on said pawl for moving said pawl into or out of engagement with said ratchet; wherein said tensioning cylinder is formed with grooves inside and adjacent said horizontally oriented radial flanges, said grooves adapted to receive ridges on said flexible fence slat.

10. A fence tensioner device for applying tension to a flexible fence slat comprising:

a bracket assembly having a pair of vertically adjustable webs for attaching the device to a fence post and a first pair of vertically spaced, horizontally oriented flanges; a first tensioning cylinder mounted for rotation within a pair of apertures provided, respectively, in said horizontally oriented flanges, said tensioning cylinder formed with a through-slot extending longitudinally between a pair of radial flanges, said through-slot having a length substantially equal to a width of the flexible fence slat and adapted to receive one end of said fence slat; wherein said bracket assembly comprises two mirror image half sections, with one vertical web on one half section in back-to-back relationship with another vertical web on the other half section, each half section formed with a respective one of said pair of horizontally oriented flanges, the half sections being fixed to each other after said tensioning cylinder is mounted within said apertures; wherein said tensioning cylinder is formed with grooves inside and adjacent said horizontally oriented radial flanges, said grooves adapted to receive ridges on said flexible fence slat.

11. The fence tensioner device of claim 10 and further including at least one multi-sided tool head on one end of said tensioning cylinder, adapted to receive a torque application tool.

12. The fence tensioner device of claim 10 and further including a second multi-sided tool head on an opposite end of said tensioning cylinder.

13. The tensioner device of claim 12 wherein said at least one multi-sided tool head and said second multi-sided tool head are located, respectively, outside said horizontally oriented flanges.

14. The fence tensioner of claim 10 wherein said two mirror image half sections are movable toward and away from each other to accommodate tensioning cylinders of different lengths.

15. A fence tensioner device for applying tension to a flexible fence slat comprising:

a bracket assembly having a pair of vertically adjustable webs for attaching the device to a fence post and a first pair of vertically spaced, horizontally oriented flanges; a first tensioning cylinder mounted for rotation within a pair of apertures provided, respectively, in said horizontally oriented flanges, said tensioning cylinder formed with a through-slot extending longitudinally between a pair of radial flanges, said through-slot having a length substantially equal to a width of the flexible fence slat and adapted to receive one end of said fence slat; wherein said bracket assembly comprises two mirror image half sections, with one vertical web on one half section in back-to-back relationship with another vertical web on the other half section, each half section formed with a respective one of said pair of horizontally oriented flanges, the half sections being fixed to each other after said tensioning cylinder is mounted within said apertures;

wherein said half sections are permanently fixed to each other by rivets.

16. A fence tensioner device for applying tension to a flexible fence slat comprising:

a bracket assembly having a pair of vertically adjustable webs for attaching the device to a fence post and a first pair of vertically spaced, horizontally oriented flanges; a first tensioning cylinder mounted for rotation within a pair of apertures provided, respectively, in said horizontally oriented flanges, said tensioning cylinder formed with a through-slot extending longitudinally between a pair of radial flanges, said through-slot having a length substantially equal to a width of the flexible fence slat and adapted to receive one end of said fence slat; wherein said bracket assembly comprises two mirror image half sections, with one vertical web on one half section in back-to-back relationship with another vertical web on the other half section, each half section formed with a respective one of said pair of horizontally oriented flanges, the half sections being fixed to each other after said tensioning cylinder is mounted within said apertures;

wherein said bracket assembly is formed with a second pair of horizontally oriented flanges adapted to mount a second tensioning cylinder in parallel and laterally spaced relationship with said first tensioning cylinder.

17. A fence tensioner assembly for applying tension to a pair of flexible fence slats comprising:

a bracket assembly having a pair of mirror-image half portions, including a pair of attachment webs in back-to-back relationship, one half portion having a first pair of laterally spaced horizontally oriented flanges along an upper edge thereof, vertically alignable with a second pair of laterally spaced horizontally oriented flanges along a lower edge of the other half portion; and a pair of tensioning cylinders mounted between the first and second pair of horizontally oriented flanges, said pair of tensioning cylinders each having a slot for receiving a free end of a fence slat, and means facilitating rotation of said pair of tensioning cylinders to tension said fence slats and means for locking said fence slats in a tensioned position.

18. The fence tensioner assembly of claim 17 wherein said mirror image half portions are adjustable to receive tensioning cylinders of different lengths.

* * * * *